US008059095B2

(12) United States Patent
Verstraelen

(10) Patent No.: US 8,059,095 B2
(45) Date of Patent: Nov. 15, 2011

(54) KEYPAD FOR A SECURITY SYSTEM

(75) Inventor: Johannes Gertrudis Raymundus Verstraelen, St. Odilienberg (NL)

(73) Assignee: UTC Fire & Security Americas Corporation, Inc., Bradenton, FL (US)

( * ) Notice: Subject to any disclaimer, the term of this patent is extended or adjusted under 35 U.S.C. 154(b) by 936 days.

(21) Appl. No.: 11/852,524

(22) Filed: Sep. 10, 2007

(65) Prior Publication Data

US 2009/0066652 A1 Mar. 12, 2009

(51) Int. Cl.
*G09G 5/00* (2006.01)

(52) U.S. Cl. ..... 345/168; 345/158; 345/169

(58) Field of Classification Search ..... 345/87–98, 345/156–178

See application file for complete search history.

(56) References Cited

U.S. PATENT DOCUMENTS

| | | | | |
|---|---|---|---|---|
| 5,550,529 | A | 8/1996 | Burge | |
| 5,625,338 | A * | 4/1997 | Pildner et al. | 340/539.3 |
| 6,137,402 | A * | 10/2000 | Marino | 340/506 |
| 6,167,464 | A | 12/2000 | Kretschmann | |
| 6,288,639 | B1 * | 9/2001 | Addy | 340/539.3 |
| 6,624,750 | B1 * | 9/2003 | Marman et al. | 340/506 |
| 6,999,562 | B2 * | 2/2006 | Winick | 379/42 |
| 7,113,099 | B2 * | 9/2006 | Tyroler et al. | 340/573.4 |
| 2005/0099299 | A1 * | 5/2005 | Tyroler et al. | 340/572.1 |

FOREIGN PATENT DOCUMENTS

| | | | |
|---|---|---|---|
| EP | 1058167 | A | 12/2000 |
| EP | 1094439 | A | 4/2001 |
| GB | 2379549 | A | 3/2003 |
| WO | 01/24149 | A | 4/2001 |
| WO | 03/079192 | A1 | 9/2003 |
| WO | 2007/021729 | A2 | 2/2007 |

OTHER PUBLICATIONS

European Search Report issued in connection with corresponding EP Patent Application No. 08163964.3 on Aug. 17, 2009.

* cited by examiner

*Primary Examiner* — Vijay Shankar
(74) *Attorney, Agent, or Firm* — Kinney & Lange, P.A.

(57) ABSTRACT

Methods, computer-readable mediums, apparatuses, and systems are provided. For example, a method is disclosed which includes identifying at least one security system function, in a plurality of security system functions, for blocked user access when a keypad is away from a predetermined location; and storing the plurality of security system functions on a processor. In another embodiment a security keypad is disclosed which includes an LCD having a static portion and a dynamic portion; a multiplexing LCD controller coupled to the dynamic portion; a static LCD controller coupled to the static portion; DC/DC converter coupled to the multiplexing LCD controller; a keypad processing unit coupled to the multiplexing LCD controller, the static LCD controller, and the DC/DC converter; and a power supply coupled to the DC/DC converter, the keypad processing unit, and the static LCD controller.

19 Claims, 6 Drawing Sheets

KEYPAD FOR A SECURITY SYSTEM

BACKGROUND OF THE INVENTION

1. Field of the Invention

Embodiments of the present invention generally relate to security systems and more particularly, to methods, computer-readable mediums, apparatuses, and systems for a security keypad display, increasing the battery life of wireless keypads, and preventing access to some features when the wireless keypad is not at a specified location(s) or within range of the specified location(s).

2. Description of the Related Art

Security systems for protecting of property (e.g., in homes) have become quite common as well as the monitoring of such systems by a central monitoring service. Initially, these security systems were hard wired systems where the various sensors and data entry keypads were hard-wired to a control panel.

Some entry keypads are wireless. However, when using wireless keypads features are sometime accessed and the wireless keypad is later misplaced. For example, a user can use the wireless keypad to activate the security system and later forget where the wireless keypad is located; and may not be able to locate the keypad in time to disarm the security system when entering the protected area, and consequently create an alarm condition. Upon reentry into the now armed structure the user is given a limited time (e.g., 30 seconds) to locate and deactivate the security system. If the user does not remember where the wireless keypad is located, a false alarm will occur if the time expires before the user can deactive the alarm system.

In addition, because of the type of information that is typically displayed on a wireless keypad the current drain on batteries in the wireless keypad reduces the life of the batteries.

A radio frequency identification ("RFID") system typically employs at least two components, a "transponder" (also known as a "tag"), which is attached to the physical item to be identified, and a "reader," which sends an electromagnetic signal to the transponder and then detects a response. Typically, the reader emits an RF signal, which is received by the transponder, after the transponder comes within an appropriate range. In response, the transponder sends its information via a modulated RF signal back to the reader. The reader detects this modulated signal, and can identify the transponder by decoding the modulated signal. After identifying the transponder, the reader can either store the decoded information or transmit the decoded signal to a computer.

Therefore, there is a great need in the art for an improved battery life in a security keypad and minimizing false alarms in a security system that avoids the shortcomings and drawbacks of prior art systems and methodologies.

SUMMARY OF THE INVENTION

Embodiments of the present invention generally relate to security systems and more particularly, to methods, computer-readable mediums, apparatuses, and systems for a security keypad display, increasing the battery life of wireless keypads, and preventing access to some features when the wireless keypad is not at a specified location(s) or within range of a specified location(s). For example, a method is disclosed which includes identifying at least one security system function, in a plurality of security system functions, for blocked user access when a keypad is away from a predetermined location; and storing the plurality of security system functions on a processor.

In addition, multiple fixed locations can be set up such that the benefits of having a portable wireless keypads remain, while preventing access to some features (e.g., the arming feature of the security system or arming the keypad to enable tamper detection) when not at (or in proximity to) a fixed location(s). For example, when a user is prevented from arming the security system there is a reduction of false alarms caused by the user not being able to disarm the security system within a preset time because of a failure to locate the keypad (i.e., the user is forced to return to (or in proximity to) the fixed location.

In another embodiment a security keypad is disclosed which includes an LCD having a static portion and a dynamic portion; a multiplexing LCD controller coupled to the dynamic portion; a static LCD controller coupled to the static portion; DC/DC converter coupled to the multiplexing LCD controller; a keypad processing unit coupled to the multiplexing LCD controller, the static LCD controller, and the DC/DC converter; and a power supply coupled to the DC/DC converter, the keypad processing unit, and the static LCD controller.

Other embodiments are also provided in which a computer-readable mediums, apparatuses, and a systems perform similar features recited by the above methods.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION OF THE PREFERRED EMBODIMENT

In the following description, numerous specific details are set forth to provide a more thorough understanding of the invention. As will be apparent to those skilled in the art, however, various changes using different configurations may be made without departing from the scope of the invention. In other instances, well-known features have not been described in order to avoid obscuring the invention. Thus, the invention is not considered limited to the particular illustrative embodiments shown in the specification and all such alternate embodiments are intended to be included in the scope of this invention. For example, although aspects disclosed herein describe prevention of accessing a feature associated with arming of a security system when a wireless keypad is not at or within a desired range of a location that description is for illustrative purposes only and not intended in any to limit the scope of the invention. It is appreciated that access to other features in the security system may be blocked when the wireless keypad is not at or within the desired range of the location, or specific features may be enabled when the wireless keypad is within the desired range of the location.

Figure 1:
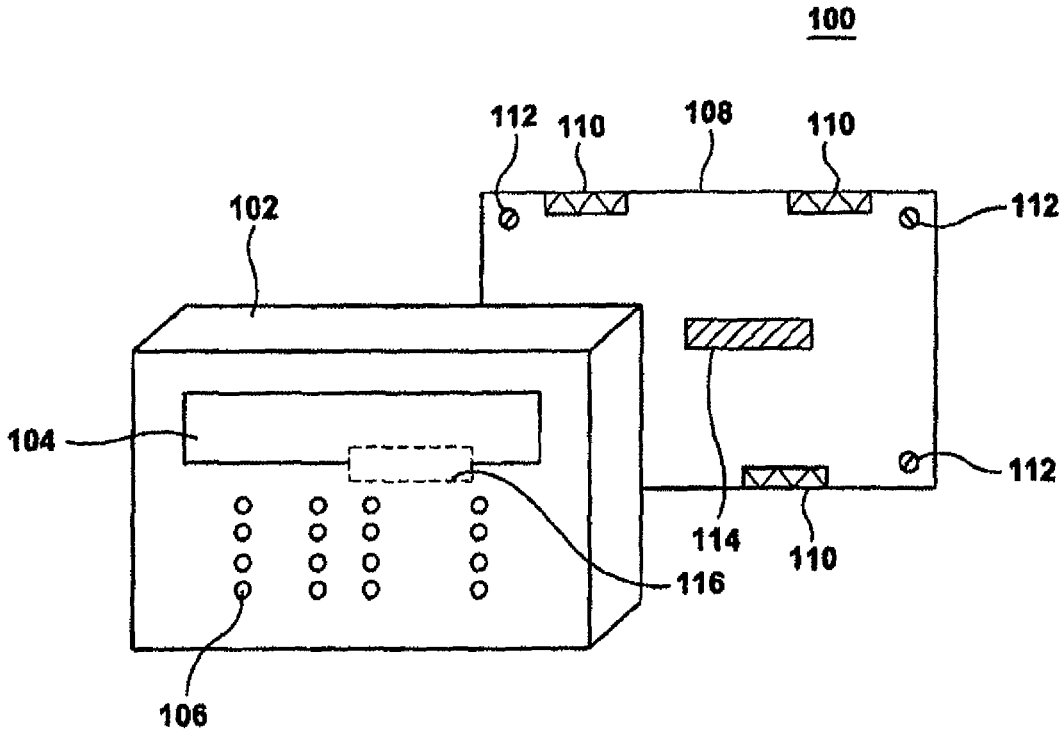
FIG. 1 depicts an embodiment of an exemplary security keypad in accordance with aspects of this disclosure.

FIG. 1 depicts an embodiment of an exemplary security keypad system 100 in accordance with aspects of this disclosure. For illustrative purposes, security keypad 100 is depicted and described herein as a wireless keypad. However, that depiction is not intended in any way to limit the scope of this disclosure. For example, in other embodiments, the keypad is wired keypad (i.e., powered by a an external source).

Security keypad system 100 includes a wireless keypad 102 and a keypad wall-mount bracket 108. The wireless keypad 102 includes a dual type information liquid crystal display ("LCD") 104; a user interface 106 (e.g., depicted as buttons for data input and/or response selection); and a tamper switch 116 (e.g., a reed switch (depicted in phantom)). The keypad wall mount bracket 108 is secured (e.g., using screws 112) to a wall (not shown) and includes snap fits 110 and a magnet 114.

In addition, the keypad 102 includes a pry-off switch and an operating battery compartment switch to protect the keypad's integrity (not shown and hereinafter referred to as a "tamper switch"). Activation of the tamper switch generates a tamper condition alarm.

To further protect against tampering, in various embodiments, the operating battery compartment can never be opened without generating an alarm unless the keypad is disarmed. When the keypad is disarmed system, an installer may determine whether the user is allowed to replace the batteries.

The installer may decide how the keypad shall behave whenever removed from the fixed location (or in proximity thereto) (e.g., a wall mounting plate). The option "always tamper" actually fixes the wireless keypad to the wall just like a wired keypad, while the option "never tamper" renders it fully portable within the reach of an RF-link. An additional option "only arm-away if on the wall" ensures that the keypad is always mounted onto its bracket before arming-away, while, once armed, the armed option "always tamper" ensures that the keypad will stay there as long as the system is armed. Knowing where the keypad is while in entry delay time (i.e., the time span to deactivate the system when entering a facility) can thus be enforced. Note, that a Master keypad may be configured to never generate a pry-off tamper.

The wireless keypad 102 may be secured to the keypad wall mount bracket 108 (and thus to the wall) by interlocking the snap fits 110 to corresponding members (not shown) on the back of the wireless keypad 102. Securing the wireless keypad 102 to the keypad wall mount bracket 108 actuates a switch (illustratively depicted in FIG. 1 as a combination of the reed switch 116 and magnet 114 and accompanying circuitry (e.g., latching relay circuitry)) that serves to indicate that the wireless keypad 102 is secured to the keypad wall mount bracket 108 (i.e., fixing the location of the wireless keypad 102). This switch may also function as the tamper switch to indicate removal of the wireless keypad 102 from the keypad wall mount bracket 108 (as indicated above).

A user is able to control a security system using the wireless keypad 102. However, when the wireless keypad 102 is not in a fixed location or in proximity to a fixed location the user is prevented from accessing a feature on the wireless keypad (e.g., the user is prevented from arming the alarm system using the wireless keypad 102). For example, when the wireless keypad 102 is not secured to the keypad wall mount bracket 108, the user will not be able to access the feature associated with arming the security system.

Figure 2:
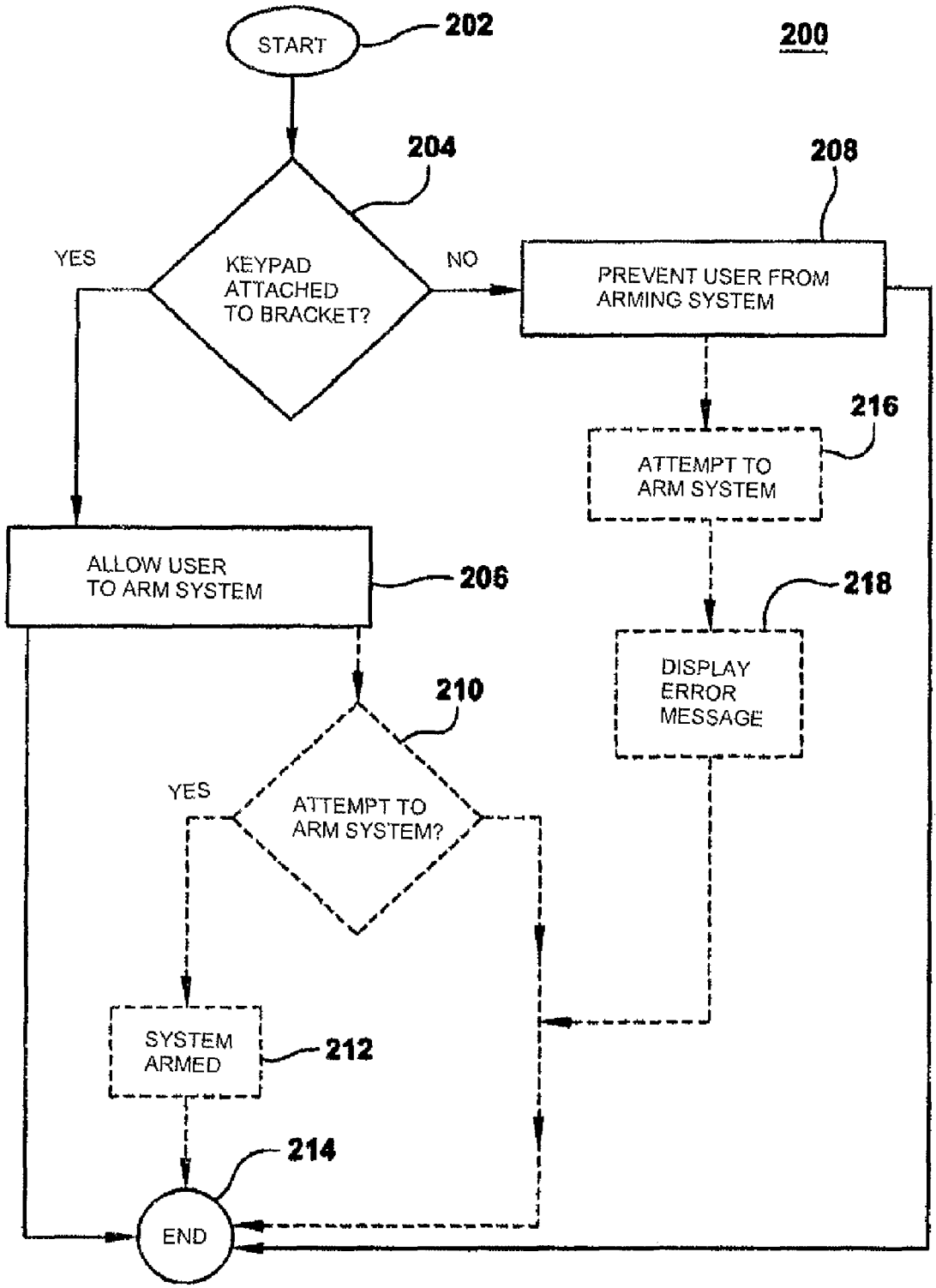
FIG. 2 depicts an embodiment of an exemplary method in accordance with aspects of this disclosure.

FIG. 2 depicts an embodiment of an exemplary method 200, which prevents the wireless keypad 102 from activating the alarm system when the wireless keypad 102 is not secured to the keypad wall mount bracket 108 (at the fixed location). The method 200 begins at step 202 and proceeds to step 204.

At step 204 the method 200 queries whether the wireless keypad 102 is removed from the keypad wall mount bracket 108. The method 200 uses software and/or hardware (in the wireless keypad 102) in conjunction with the mechanical switch (e.g., the reed switch 116 and magnet 114) to determine whether the wireless keypad 102 is removed from the keypad wall mount bracket 108. If the query is answered affirmatively (i.e., the keypad 102 is secured to the keypad wall mount bracket 108), the method 200 proceeds to step 206.

At step 206, software and/or hardware (in the keypad 102) in conjunction with the mechanical switch (e.g., the reed switch 116 and magnet 114) determines that the keypad 102 is at a desired location (i.e., secured to the keypad wall mount bracket 108) allows access to an arm alarm system function. Thereafter, the method 200 proceeds to and ends at step 214.

If, however a negative query is made at step 204, the method proceeds to step 208. At step 208, software and/or hardware (in the wireless keypad 102) in conjunction with the mechanical switch (e.g., the reed switch 116 and magnet 114) blocks arming of the alarm system while the wireless keypad 102 is removed from the keypad wall mount bracket 108. Thereafter, the method 200 proceeds to and ends at step 214.

In addition, method 200 contains optional steps 210, 212, 216, and 218, which are not needed to practice the invention. As such, steps 210, 212, 216, and 218 are depicted with dashed lines. Note that steps 216 and 218 provide the status (i.e., the ability to access a feature illustratively described herein and depicted in FIG. 2 as the arming feature (illustrative icons are shown at number "13" in "Table 1" below) of the keypad 102). In various embodiments, the status (i.e., whether a feature is blocked) of the feature is contantly displayed and updated as the status changes.

After step 206, when the wireless keypad 102 is in a mode, which will allow a user to arm the alarm system, the method 200 proceeds to optional step 210. At optional step 210, the method 200 queries whether an attempt is made to arm the alarm system. If the attempt is successful (e.g., the proper security code is input and/or response(s)) the method proceeds to optional step 212. At optional step 212 the alarm system is armed. Thereafter the method 200 proceeds to and ends at step 214. If, however, a negative determination is made at optional step 210 (i.e., the attempt to arm the system was unsuccessful), the method 200 proceeds to and ends at step 214.

As indicated above, FIG. 2 contains optional steps 210, 212, 216, and 218. Returning to step 208 in FIG. 2. After step 208 the method 200 proceeds to optional step 216.

At optional step 216, an attempt is made to arm the alarm system. However, a negative determination was made at step 204; and software and/or hardware in conjunction with the mechanical switch (e.g., the magnet 114 and reed switch 116) prevents a user from arming the system at step 208. As such, at optional step 216 the attempt to arm the system is denied. After optional step 216, the method 200 proceeds to optional step 218.

At optional step 218 the dual type information LCD 104 displays an error message indicative an inability to allow arming the alarm system. After optional step 218, the method 200 proceeds to and ends at step 214.

Figure 3:
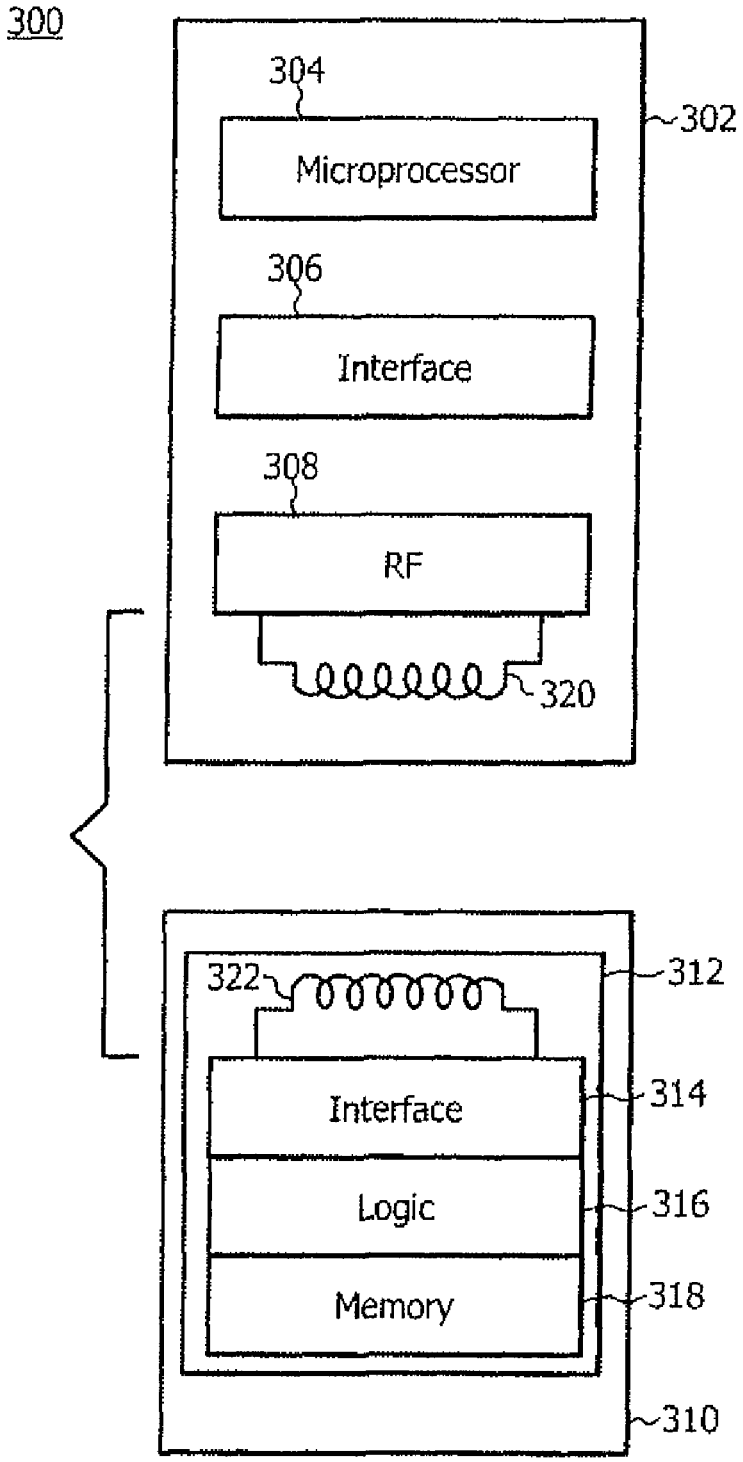
FIG. 3 depicts an embodiment of a block diagram of an exemplary reader/transponder pair in accordance with aspects of this disclosure.

FIG. 3 shows a general example of a reader/transponder pair 300 used in accordance with this disclosure. In various embodiments (and in conjunction with the wall mount bracket and reed switch/magnet combination), wireless technology is used to determine the location of the keypad, such as radio frequency identification ("RFID") or Near Field Communication ("NFC") technology. In yet other embodiments, the reader/transponder pair 300 is described using a passive transponder 310. However, it is appreciated that other types of transponders may be used in accordance with this disclosure. The reader/transponder pair includes a reader 302 and the transponder 310.

The reader 302 is integrated into the keypad housing. It includes a microprocessor 304, a radio frequency ("RF") modulator 308 having an antenna 320, and an interface 306 to communicate information between the microprocessor 304 and the RF modulator 308.

The transponder 310 may be integrated into wall mount bracket 108 or may be in the form of a sticker attached to some item (e.g. a cabinet or may be included in a housing 312). It consists of an antenna 322 coupled to an interface 314, logic 316, and memory 318. When the reader 302 transmits an interrogation signal, via antenna 320, the transponder antenna 322 receives the interrogation signal. The coil antenna 322 and interface 314 includes a passive resonant radio RF circuit (not shown) for use in detecting when the transponder 310 is within a zone monitored by the reader 302 and for providing power to the transponder 310. Furthermore, the transponder 310 provides "intelligence" to the transponder 310 via logic circuits 316. Memory 318 is coupled to the logic circuits 316. When prompted the logic circuits gathers information from memory 318 and returns a signal containing a packet of preprogrammed information. The packet of information (data pulses) is received and processed by reader 302 receiving circuitry and is decoded (if necessary) to provide identification information about the item upon which the transponder 310 is attached.

The distance between which a reader 302 communicates with the transponder 310 is small. As such, by securing the transponder 310 to a location (e.g., a wall near a door or in a bedroom) the reader 302 will only communicate with the transponder 310 when the reader 302 is close enough to the place where the transponder 310 is mounted. Thus, when the reader 302 is in communication with the transponder 310, the location of the reader 302 is limited to a relatively small area. In addition, multiple transponders may be secured in different locations so that the reader 302 (and as explained below the wireless keypad 102) can be used in more than one location and block arming or offer selective arming of areas of the security system depending of the location that the keypad is at.

Figure 4:
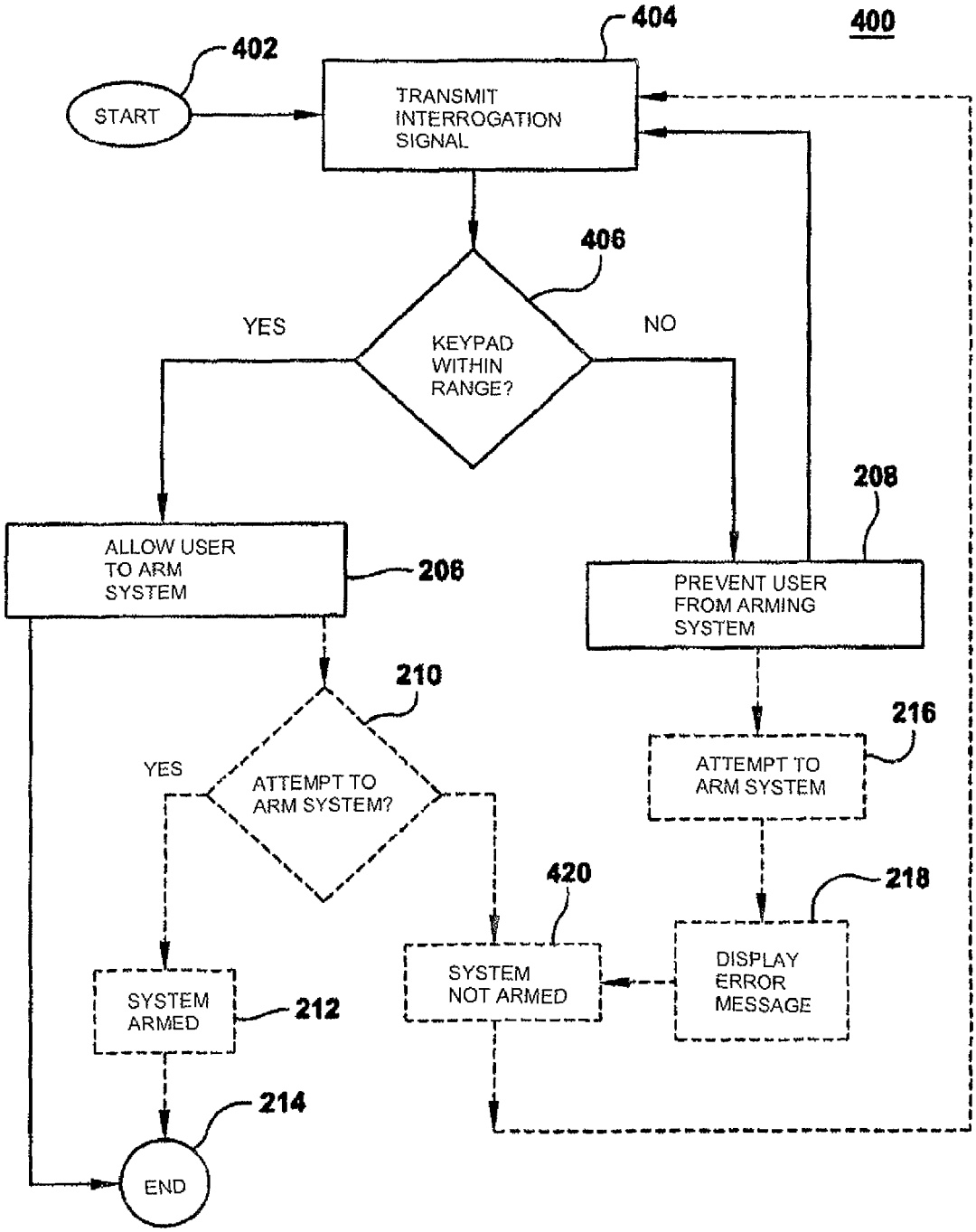
FIG. 4 depicts an embodiment of another exemplary method in accordance with aspects of this disclosure.

FIG. 4 depicts an embodiment of another exemplary method 400 in accordance with aspects of this disclosure. For illustrative purposes, the method 400 is described using RFID wireless technology. However, this illustration is not intended in any way to limit the scope of the invention. It is appreciated that other wireless technologies can be used in accordance with this disclosure. In addition, steps 206, 208, 210, 212, 216, and 218 have been described above with respect to FIG. 2. The same element numbers are used when describing some aspects of FIG. 4. For brevity, when the same element numbers are used an explanation of their operation is not repeated.

For example, the method 400 prevents arming of a security system using a wireless keypad (e.g., wireless keypad 102) when the wireless keypad is not within a close proximity of at least one fixed location. The method 400 begins at step 402 and proceeds to step 404.

As indicated in FIG. 3, the wireless keypad 102 contains an RFID reader 302. Returning to FIG. 4, at step 404, the reader 302 transmits an interrogation signal for receipt by at least one transponder 310. The interrogation signal can be sent intermittently, continuously, or upon initiation by a user. After transmission of the interrogation signal, the method 400 proceeds to step 406.

At step 406, the method 400 queries whether the wireless keypad 102 is within range of the transponder(s) 310. When the reader 302 in the wireless keypad 102 receives a signal from the transponder(s) 310 (because of the limited RFID range a received signal indicates that the wireless keypad 102 is within close proximity), the query is answered in the affirmative and proceeds to step 206.

At step 206, software and/or hardware in conjunction with information received from the reader 302 allows access to the arming feature in the security system. Thereafter, the method proceeds to and ends at step 214.

If however a signal is not received from the transponder(s) 310 at step 406, the method 400 proceeds to step 208.

At step 208, software and/or hardware in conjunction with information received from the reader 302 does not allow access to the arming feature of the security system. Because the wireless keypad 102 is a mobile device (i.e., there are times when the wireless keypad 102 is possibly not within a desired distance from the transponder 310 (i.e., the desired location), the method 400 (in various embodiments) proceeds to step 404 so that the reader 302 continuously transmits an interrogation signal for the subsequent query at step 406.

In various embodiments method 400 can include optional steps 210, 212, 216, 218, and 420, which are not needed to practice the invention. As such, steps 210, 212, 216, 218, and 420 are depicted with dashed lines.

After step 206, the method 400 proceeds to optional steps 210 and 212 as described above. Thereafter the method 400 proceeds to and ends at step 416. If however, a negative determination is made at step 210 the method 400 proceeds to step 420 (described in detail below).

After step 208, method 400 proceeds to optional steps 216 and 218 as described above. However, after step 218, the method 400 proceeds to optional step 420.

At optional step 420 the attempt to arm the system is denied. After optional step 420, the method 400 proceeds to step 404 and operates as indicated above.

Although FIG. 4 has been described above using RFID that description is not intended in any way to limit the scope of this disclosure. It is appreciated that other wireless technologies can be incorporated herein to assist in determining whether access to a feature(s) should be blocked. For example, ultra-wideband ("UWB") circuitry can be incorporated into the security keypad 102. As used herein (and as defined by the Institute of Electrical and Electronic Engineers ("IEEE"); and the International Telecommunication Union-Radiocommunication Section ("ITU-R")) UWB is defined as any radio technology having bandwidth exceeding the lesser of 500 MHz or 20% of the arithmetic center frequency. In various embodiments, other known location estimation techniques may used such as UWB based time of flight calculation algorithms which estimate the position of the RF keypad by triangular calculations of the RF signal from various fixed location based transponders.

Figure 5:
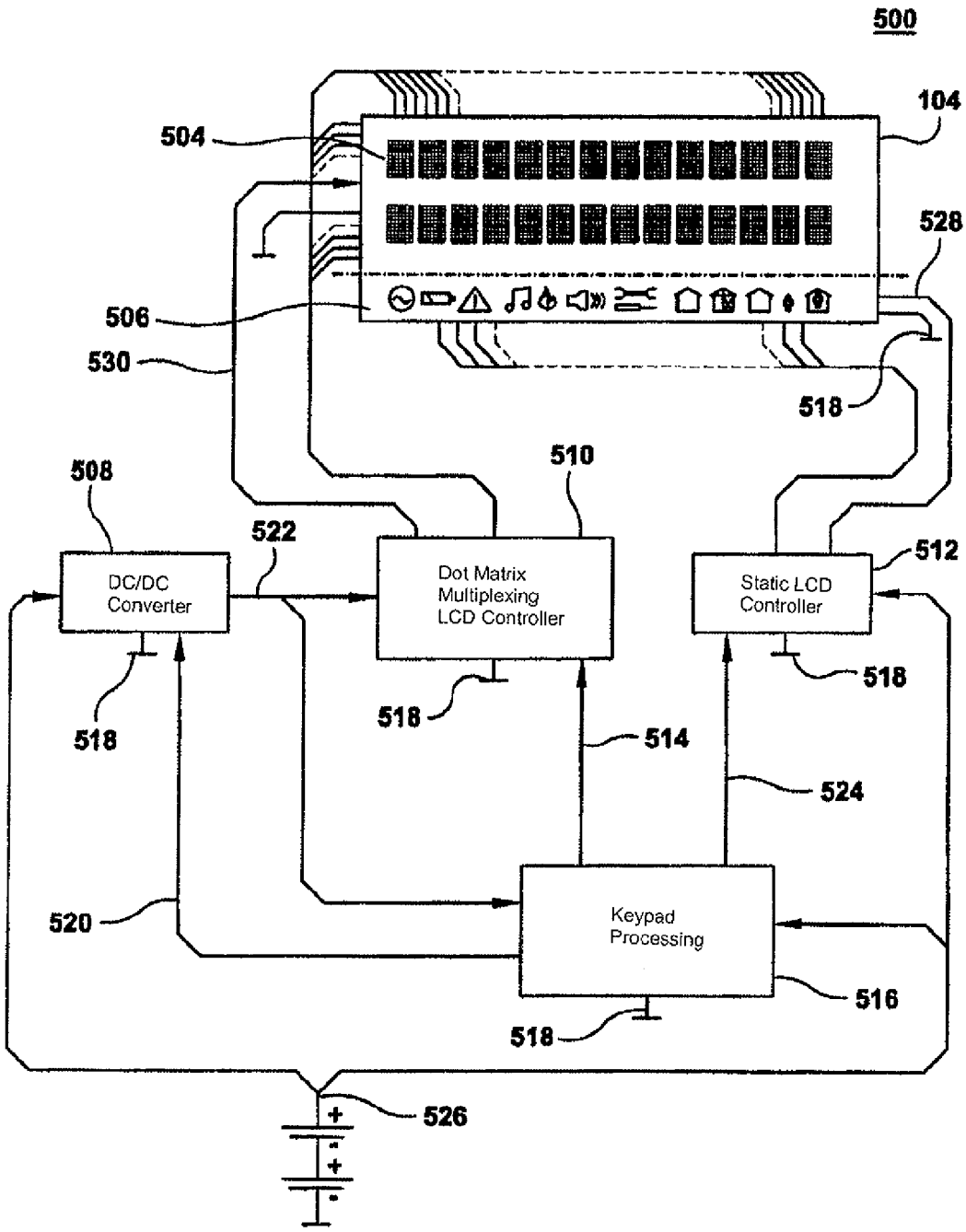
FIG. 5 depicts an embodiment of a high level block diagram of an exemplary liquid crystal display and supporting circuitry in accordance with aspects of this disclosure.

Aspects of this disclosure also include increasing the battery life of a wireless keypad. Embodiments disclosed herein increase the battery life by reducing the amount of current (i.e., power) needed by the LCD. FIG. 5 depicts an embodiment of a high-level block diagram 500 of an exemplary LCD and supporting circuitry in accordance with aspects of this disclosure.

The block diagram 500 includes dual type information LCD 104, a DC/DC converter 508, a Dot Matrix Multiplexing LCD controller 510, a Static LCD controller 512, a Keypad Processor 516, and a power supply 526. The dual type information LCD 104, DC/DC converter 508, Dot Matrix Multiplexing LCD controller 510, Static LCD controller 512, and Keypad Processor 516 are each connected to ground 518.

For illustrative purposes, power supply 516 is described as a battery (e.g., a plurality of AA size batteries).

In addition, display 502 is depicted as having two rows of character segments for the dynamic information display portion 504. However, that depiction is not intended in any way to limit the scope of the invention. It is appreciated that one or more rows of character segments (e.g., 2 rows of 16 characters of alphanumeric data) in the dynamic information display portion 504 is within the scope of this disclosure. Further, the static information display portion 506 is depicted as having a single row of static icons. However, the icons depicted (and also the depiction as a single row of icons) are for illustrative purposes only and not intended in any way to limit the scope of the invention. It is appreciated that the static information display portion 506 can utilize different icons and be depicted in more than one row. For illustrative purposes, Table 1 is provided and includes a non-exhaustive list of exemplary icons.

indicated by the icons. In various embodiments, the dynamic information display portion 504 will not display date and time, nor any other type of message while the dynamic information display portion 504 is OFF.

The illustrative dual type information LCD 104 is capable of displaying two or more types of information simultaneously (i.e., static display information and dynamic display information) on one LCD panel. Note that in various embodiments, the static display information includes, but is not limited to, mandatory minimum security system status indicators (e.g., minimum requirements under European Norm 50131 ("EN50131")). Various LCD technologies can be incorporated into the invention. For example, an LCD display based upon super twist nematic ("STN") technology can be incorporated into embodiments of this disclosure.

Although keypad-processing unit 516 is depicted as a singular unit that depiction is for illustrative purposes only. For example, the keypad-processing unit 516 can contain two separate processors—one processor for controlling static information and the other processor for controlling dynamic information.

When the keypad-processing unit 516 is "on" a character display control signal 520 supplies power to (and activates) the DC/DC converter 508. When the DC/DC converter 508 is on, the DC/DC converter output 522 (also known as $V_{cc}$ 522) supplies power to the Dot Matrix Multiplexing LCD 510

TABLE 1

LCD icons

| | Symbol | Name | Description |
|---|---|---|---|
| 1 | | Mains | If mains is present, the left icon is displayed. If mains is failing, the right icon shows up. Panel battery low is indicated by flashing the icon, either the left one or the right one. Note, that the icons take a single icon position, the dash just being some extra pixels. |
| 2 | | Bypass | In MASTER mode, the left icon shows up if ANY partition is in STAY. In PARTITION mode, the right icon, sharing position with icon 5 below, is being displayed if ANY zone is bypassed. |
| 3 | | Full/Part armed | In MASTER mode, the FULL icon (left) shows up only if ALL partitions are ARMED, while the PART icon (right) shows up if NOT ALL partitions are ARMED. Icons take a single icon position. |
| 4 | | Stay/Night | In PARTITION mode, the STAY icon (left) shows up if armed and staying, and the NIGHT icon (right) if the night function is enabled. The icons take a single icon position. |
| 5 | | Away | In PARTITION mode, one of these icons shows up if armed and leaving, the left one if ANY zone is bypassed, the right one if NO zone is bypassed. Icons share the same position, also see icon 2. |
| 6 | | Chime | In CHIME mode, this icon will be ON, otherwise OFF. |
| 7 | | Fire | This icon will flash ON and OFF if a fire zone or the fire keypad function has been activated. |
| 8 | | Battery low | If the keypad battery is low, this icon is flashing ON and OFF. |
| 9 | | Alarm | This icon flashes ON and OFF in case of an alarm condition. |
| 10 | | | This icon indicates RF-link field strength. The leftmost one indicates absence of RF, the rightmost one full signal strength. It will flash ON and OFF as long as the keypad's not registered yet. |
| 11 | | Trouble | This icon indicates a system trouble condition by flashing ON and OFF |
| 12 | | Service | This icon is flashing ON and OFF in case the system needs to be serviced. |
| 13 | | Ready to arm | If the system is OK to arm, the icon shows a rectangle + V-sign. If it is NOT OK to arm, the icon shows a rectangle + X-sign. In case of a FORCED ARM, it will show a rectangle + V-sign flashing ON and OFF. |

In various embodiments, the dynamic information display portion 504 section showing alphanumeric data is only turned ON while a user is operating the keypad 102, and turned OFF after an expiration of a predetermined time (e.g., 30 seconds after the last key is hit); and the static information display portion 506 is always enabled to show the status information controller to the dynamic information processor in the keypad-processing unit 516. In response thereto, the keypad-processing unit 516 transmits data, via transmission line 514, to the Dot Matrix Multiplexing LCD controller 510 indicative of the characters to be displayed. The Dot Matrix Multiplexing LCD controller 510 interprets the data received from the keypad-processing unit 516 and illuminates the appropriate pixels in the dynamic information display portion 504 in dual type information LCD 104. The Dot Matrix Multiplexing LCD controller 510 also supplies power (about 3.6 volts), via transmission line 530, to the dynamic information display portion 504.

In addition, the keypad-processing unit 516 transmits icon data (i.e., static information) via transmission line 524 to the Static LCD controller 512. The Static LCD controller 512 also supplies power (about 1.8 volts to about 3.3 volts), via transmission line 528, to the static information display portion 506.

Figure 6:
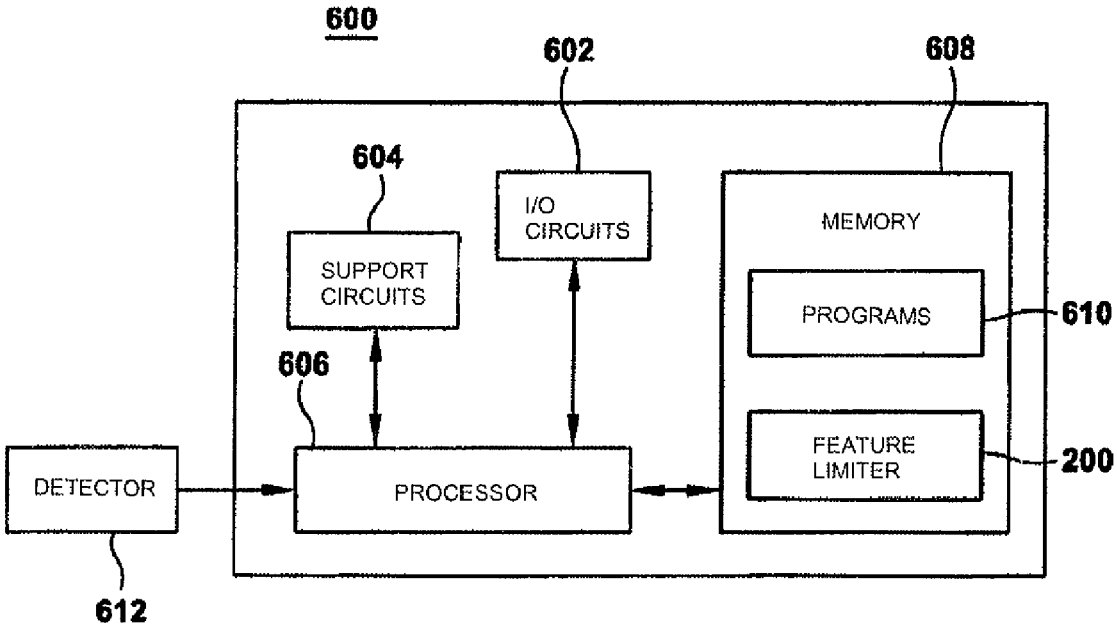
FIG. 6 depicts a high level block diagram of a computer architecture in accordance with aspects of this disclosure.

FIG. 6 depicts FIG. 6 depicts a high level block diagram of an embodiment of a controller 600, as part of electronic circuitry, suitable for use in preventing access to some features when the wireless keypad is not at a specified location(s) or within range of a specified location(s). The controller 600 of FIG. 6 comprises a processor 606 as well as a memory 608 for storing control programs 610 and the like. In addition, the memory 608 can also store the feature limiting method 200 (as explained above in FIG. 2). Although FIG. 6 is depicted as including the feature limiting method 200 it is appreciated that controller 600 can include, in alternative embodiments, instructions for performing method 400. The processor 606 cooperates with conventional support circuitry 604 such as power supplies, clock circuits, cache memory and the like as well as circuits that assist in executing the software routines stored in the memory 608. As such, it is contemplated that some of the process steps discussed herein as software processes may be implemented within hardware, for example, as circuitry that cooperates with the processor 606 to perform various steps. The controller 600 also contains input-output circuitry 602 that forms an interface between the various functional elements communicating with the controller 600. For example, in various embodiments, the controller 600 also communicates with a user interface (e.g., buttons 106 on keypad 102) allowing a user to input desired characters and/or responses.

Although the controller 600 of FIG. 6 is depicted as a general-purpose computer that is programmed to perform various control functions in accordance with the present invention, the invention can be implemented in hardware, for example, as an application specified integrated circuit (ASIC). As such, the process steps described herein are intended to be broadly interpreted as being equivalently performed by software, hardware, or a combination thereof.

In various embodiments, the wireless keypad 102 is configured to communicate with a security system, the wireless keypad 102 includes a detector 612 configured to determine whether the wireless keypad 102 is attached or in proximity to a fixed location; a processor 606 coupled with the detector 612; and a memory 608 coupled with the processor 606, wherein the memory 608 contains instructions that when executed by the processor 606 prevent the security system from being armed when the detector 612 indicates the wireless keypad is neither attached to nor in proximity to the fixed location. The fixed location (or a proximity thereto) can be demarcated by a bracket and/or an RFID tag(s). For example, in various embodiments of the wireless keypad 102, the fixed location is a bracket 108 configured to attach to the wireless keypad, and wherein the detector 612 is a mechanical switch internal to the wireless keypad 102 that is configured to be operated by a mating part of the bracket (e.g., snapfits 110) when the wireless keypad 102 is attached to the bracket (e.g., a wall bracket, bracket 108, and the like). In other embodiments of the wireless keypad 102, the fixed location is a bracket configured to attach to the wireless keypad 102, and the detector 612 is a reed switch 116 internal to the wireless keypad 102 that is configured to be operated by a magnet 114 attached to the bracket 108 when the wireless keypad 102 is attached to the bracket 108. In yet other embodiments of the wireless keypad 102, the fixed location is an RFID tag(s) 310, and wherein the detector is an RFID reader 302 internal to the wireless keypad that is configured to detect the RFID tag(s) 310 when the wireless keypad 102 is in proximity to the RFID tag(s) 310.

In various embodiments, the location of the keypad (or proximity to a predetermined location(s)) can be derived from other systems (i.e., systems other than the security system). For example, the system can be a phone network used to estimate the location of a cellular phone (e.g., a global system for mobile communications ("GSM") phone) or a radio frequency ("RF") transceiver. For example, an RF transceiver can be placed in multiple rooms or locations and the Rf transceiver that receives the strongest signal is most likely the transceiver closest to the wireless keypad.

While the foregoing is directed to embodiments of the present invention, other and further embodiments of the invention may be devised without departing from the basic scope thereof, and the scope thereof is determined by the claims that follow.

I claim:

1. A wireless security system keypad comprising:

a detector configured to determine at least one of an attachment of said wireless keypad to a fixed location and a proximity of said wireless keypad to said fixed location;

a processor coupled to said detector;

a memory coupled to said processor, wherein the memory contains instructions that when executed by said processor prevent access to a least one function when said detector fails to indicate one of said attachment and said proximity;

a liquid crystal display ("LCD") comprising a static portion and a dynamic portion;

a multiplexing LCD controller coupled to said dynamic portion;

a static LCD controller coupled to said static portion;

a direct current to direct current ("DC/DC") converter coupled to said multiplexing LCD controller;

a keypad processing unit coupled to said multiplexing LCD controller, said static LCD controller, and said DC/DC converter; and a power supply coupled to said DC/DC converter, to said keypad processing unit, to and said static LCD controller.

2. The wireless security system keypad of claim 1 wherein said multiplexing LCD controller is adapted to control said power supply and said power supply is adapted to provide power to said dynamic portion for transmission of dynamic data.

3. The wireless security system keypad of claim 2 wherein said power provided by said multiplexing LCD controller is about 3.6 volts.

4. The wireless security system keypad of claim 1 wherein said static LCD controller is adapted to provide static data to said static portion.

5. The wireless security system keypad of clam 1 wherein said DC/DC converter is adapted to provide power to said multiplexing LCD controller and said keypad processing unit.

6. The wireless security system keypad of claim 5 wherein said power provided by said DC/DC converter is about 3.3 volts.

7. The wireless security system keypad of claim 1 wherein the keypad processing unit is adapted to provide dynamic data to said multiplexing LCD controller, icon data to said static LCD controller, and an ON/OFF power control signal to said DC/DC converter.

8. The wireless security system keypad of claim 1 wherein said power supply is adapted to provide about 1.8 volts to about 3.3 volts to said DC/DC converter, said keypad processing unit, and said static LCD controller.

9. The wireless security system keypad of claim 1 wherein said LCD is a super twist nematic LCD.

10. The wireless security system keypad of claim 1, wherein said fixed location is a bracket configured to attach to said wireless keypad, and said detector comprises a reed switch internal to said wireless keypad, said reed switch configured for operation with a magnet attached to said bracket when said wireless keypad is attached to said bracket.

11. The wireless security system keypad of claim 1, wherein said fixed location comprises at least one radio frequency identification ("RFID") tag, and said detector comprises a RFID reader internal to said wireless keypad, said RFID reader is configured to communicate with said RFID tag.

12. A method, comprising:

identifying at least one security system function, in a plurality of security system functions, for blocked user access when a wireless keypad is not mounted at or positioned proximate a predetermined location, wherein the at least one function comprises a security system arming function;

storing said plurality of security system functions on a processor; and preventing a user from performing the security system arming function unless the wireless keypad is detected as being mounted at or positioned proximate the predetermined location.

13. The method of claim 12 further comprising installing said processor into a security keypad.

14. The method of claim 12 further comprising installing a dual mode liquid crystal display ("LCD") wherein said LCD is adapted to display static information and dynamic information.

15. The method of claim 12, further comprising:

installing said processor into a security keypad; and installing at least one of a mechanical switch and wireless communication circuitry into said security keypad, wherein said mechanical switch and said wireless communication circuitry are adapted to provide assistance in acquiring a location of said security keypad.

16. The method of claim 15 wherein said wireless communication circuitry is a radio frequency identification ("RFID") reader.

17. The method of claim 12 wherein said wireless communication circuitry is one of an ultra-wide band transmitter and an ultra-wide band transceiver.

18. A wireless security system keypad, comprising:

a wireless keypad;

a detector configured to determine at least one of an attachment of said wireless keypad to a fixed location and a proximity of said wireless keypad to said fixed location;

a processor coupled to said detector; and a memory coupled to said processor, wherein the memory contains instructions that when executed by said processor prevent a user from performing a security system arming function when said detector fails to indicate one of said attachment and said proximity.

19. The wireless security system keypad of claim 18, wherein said fixed location comprises a bracket configured to attach to said wireless keypad, and said detector comprises a mechanical switch internal to said wireless keypad, said mechanical switch configured for operation with a mating part of said bracket when said wireless keypad is attached to said bracket.

* * * * *